United States Patent [19]

Rosenstein

[11] 4,239,002

[45] Dec. 16, 1980

[54] PRINTING CODER

[76] Inventor: David Rosenstein, 2808 Zarthan Ave. S., Minneapolis, Minn. 55416

[21] Appl. No.: 44,864

[22] Filed: Jun. 4, 1979

[51] Int. Cl.[3] ..... B41F 27/06

[52] U.S. Cl. ..... 101/377; 101/376; 101/368; 101/110

[58] Field of Search ..... 101/368, 375-380, 101/370, 404, 110

[56] References Cited

U.S. PATENT DOCUMENTS

| | | | |
|---|---|---|---|
| 2,409,409 | 10/1946 | Wild et al. | 101/377 |
| 2,613,602 | 10/1952 | Retter et al. | 101/404 |
| 2,746,389 | 5/1956 | Alessi, Jr. et al. | 101/377 |
| 3,340,804 | 9/1967 | Price, Jr. | 101/375 |
| 3,927,613 | 12/1975 | Nantz | 101/110 |
| 3,968,747 | 7/1976 | Johnson | 101/376 |
| 4,149,460 | 4/1979 | Sato | 101/110 |

FOREIGN PATENT DOCUMENTS

| | | | |
|---|---|---|---|
| 2372704 | 8/1978 | France | 101/377 |

*Primary Examiner*—William Pieprz

*Attorney, Agent, or Firm*—Jacobson and Johnson

[57] ABSTRACT

A printing wheel or cylinder is formed by a plurality of discs stacked one over another with resilient spacers between them to provide spaces at the outer edges to receive the backing ribs of printing type. The discs are squeezed together to securely grasp the backing ribs and are loosened to remove or replace the printing type.

6 Claims, 1 Drawing Figure

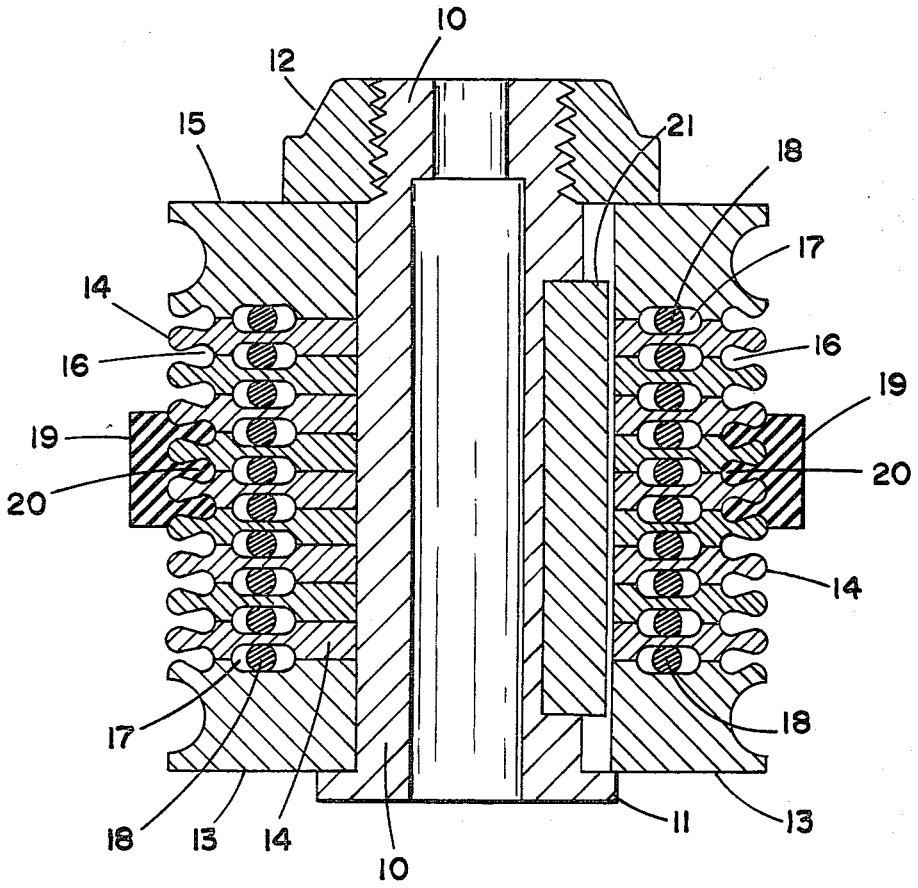
10
12
15
21
18
17
14
16
16
19
19
20
20
14
17
18
18
13
14
10
11
13

PRINTING CODER

BACKGROUND OF THE INVENTION

1. Field of the Invention

This invention is directed for use in conjunction with equipment for closing or sealing containers such as bags, boxes, or the like. Generally speaking, after the container has been sealed closed it is necessary or desirable to imprint information across or near the sealed edge. This is done with a device called a printing coder. For continuous and automatic action, the coder is preferrably in wheel or cylindrical form with the printing type mounted on the outside of the cylinder or wheel.

2. Description of the Prior Art

A variety of printing coders have been used in the past. One of these is a printing cylinder in which a rubber sheet is adhesively attached to the outer surface of a cylinder. The type font is inserted in grooves or slots on the outer face of the rubber sheet. This has a decided drawback when the printer is used in conjunction with other machinery because the print type has a tendency to work loose because of the vibration of the equipment and the speed of rotation of the coder cylinder.

Another prior art device is shown in U.S. Pat. No. 2,874,637 and consists of a wire coil mounted on the outside of a cylinder with the spaces between the coil windings being used to hold the type print in place. This device also suffers in its ability to securely hold the type under vibration. Also, if the coils are spaced close enough to try to hold the type tightly, then it may be difficult to remove the type to insert new type print.

Another prior art device is shown in U.S. Pat. No. 2,643,609. This consists of a number of rings stacked on one another to provide spaces at the outer edge of the rings for receiving the gripping or backing ribs of the printing type. In this device the spaces must be dimensioned fairly accurately to insure that when the rings are squeezed together that the ribs do not lay loosely in the spaces between the rings. Another difficulty with the latter device is that the rings have to be separated or pushed apart in order to insert the ribs. This is especially difficult in the case of a large diameter printing wheel where the rings might be as large as 7½ inches in diameter.

SUMMARY OF THE INVENTION

A plurality of discs of equal diameter are stacked on one another with resilient spacers between them. The space between adjacent discs at their outer edges accept the backing ribs on the print type and the discs are compacted together to securely grasp the type print in place. When the tightening device is unloosened, the discs push apart by virtue of the resilient spacers so that the type can easily be removed and replaced or moved as desired. This is particularly desirable in the case of a large diameter printing wheel. This arrangement insures that when the discs are squeezed together they securely hold the type face in place and the type face is unable to work loose under the most rigorous vibration or fast rotational speed of the cylinder. Yet the type can be quickly and easily replaced or moved around.

BRIEF DESCRIPTION OF THE DRAWING

The FIGURE is a sectional view of a preferred embodiment of the invention.

DESCRIPTION OF THE PREFERRED EMBODIMENT

An elongated bushing 10 has a flange 11 at its lower end and is threaded at its upper end to accept nut 12. A first retainer 13 rests on the flange 11 and a plurality of annular discs 14 are stacked and rest on the retainer 13. A second retainer 15 rests on the top most disc under nut 12. The discs 14 and the retainers 13 and 15 are secured in a non-rotating relationship to bushing 10 by key 21.

Each of the discs 14 has its outer edge shaped so that between adjacent discs there is formed a bulbous opening 16. Each of the discs also has an annular groove 17 in which rests a resilient spacer or "O" ring 18.

Printing type 19 has the type font, not shown, on its outer suface and its under surface has ribs 20 which are shaped to conform to the bulbous opening 16. Preferrably, the ribs 20 are resilient.

When nut 12 is loosened, the "O" rings 18 urge the discs 14 apart so that the ribs 20 of the printing type 19 can be easily inserted into the spaces or openings 16. The nut 12 is then tightened down on the upper retainer 15 to press the discs together against the lower retainer 13 against the action of the "O" rings 18 to securely grasp the supporting ribs 20 and thereby hold the printing type securely and rigidly in place. To remove the type face and replace it with another, nut 12 is loosened and the print type 19 is easily slipped out of the spaces between the discs and a new printing type inserted and the nut again tightened down.

Typically, and for exemplary purposes only, the printing coder of the nature described above for printing on a container such as a sealed bag about twenty-two inches wide may consist of a stack of perhaps ten or twelve discs with each disc being about two inches in diameter. This permits the printing type to make repeated prints along the edge of the bag. If only a single print is desired, then the discs are chosen to be about 7½ inches in diameter for a twenty-two inch bag. As can be observed, either a single line or multiple lines of print can be applied to the container.

I claim:

1. A magazine for holding printing type on a cylindrical coder, comprising:

a. a plurality of coaxially stacked equal diameter discs having spaces at their outer edges between adjacent discs for receiving the backing ribs of a print type;

b. means located radially inward between adjacent discs for yieldably urging the discs apart axially; and c. means for axially releasably compacting the discs together to compress said yieldable means whereby the discs securely grasp the inserted type backing ribs at the outer edges of the discs.

2. The coder magazine as described in claim 1 wherein said yieldable means comprises resilient spacers.

3. The coder magazine as described in claim 2 wherein said resilient spacers comprise resilient "O" rings resting in grooves on a flat surface of the discs.

4. The coder magazine as described in claim 1 wherein said discs are annular and are movably mounted on a coaxial rod, said rod including means attached thereto for compacting the discs together axially.

5. A coder print wheel assembly comprising, in combination:

a. a plurality of equal diameter coaxially stacked discs having spaces at the outer edges between adjacent discs for receiving the backing ribs of a print member;

b. means located radially inward between adjacent discs for yieldably urging the discs apart axially;

c. print type having backing ribs inserted in the space between at least two adjacent discs; and d. means for releasably compacting the discs together axially to compress said yieldable means whereby the discs securely grasp the print type backing ribs at the outer edges of the discs.

6. The invention as in claim 5 wherein the print type backing ribs are resilient.

* * * * *